US008399169B2

(12) United States Patent
Joo et al.

(10) Patent No.: US 8,399,169 B2
(45) Date of Patent: Mar. 19, 2013

(54) ELECTROPHOTOGRAPHIC TONER AND METHOD OF PREPARING THE SAME

(75) Inventors: Hae-ree Joo, Anyang-si (KR); Deuk-woo Jang, Yongin-si (KR); Woo-sung Jeon, Suwon-si (KR); Kyeong Pang, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 457 days.

(21) Appl. No.: 12/683,610

(22) Filed: Jan. 7, 2010

(65) Prior Publication Data

US 2010/0173242 A1 Jul. 8, 2010

(30) Foreign Application Priority Data

Jan. 8, 2009 (KR) ..... 10-2009-0001596

(51) Int. Cl.
*G03G 9/08* (2006.01)

(52) U.S. Cl. ..... 430/111.4

(58) Field of Classification Search ..... 430/111.4
See application file for complete search history.

(56) References Cited

U.S. PATENT DOCUMENTS

2009/0075195 A1* 3/2009 Shu et al. ..... 430/109.4

* cited by examiner

*Primary Examiner* — Mark A Chapman
(74) *Attorney, Agent, or Firm* — Stanzione & Kim, LLP

(57) ABSTRACT

An electrophotographic toner which includes a latex, a colorant, and a releasing agent, wherein characteristics of the electrophotographic toner measured by using a Fourier transform infrared spectroscopy in an attenuated total reflection mode (FT-IR-ATR), in which an incidence angle is changeable, satisfy Inequalities 1 through 3 presented herein.

11 Claims, 2 Drawing Sheets

ELECTROPHOTOGRAPHIC TONER AND METHOD OF PREPARING THE SAME

CROSS-REFERENCE TO RELATED APPLICATIONS

This application claims priority under 35 U.S.C. §119(a) from Korean Patent Application No. 10-2009-0001596, filed on Jan. 8, 2009, in the Korean Intellectual Property Office, the disclosure of which is incorporated herein by reference in its entirety.

BACKGROUND

1. Field of the Invention

The present general inventive concept relates to an electrophotographic toner and a method of preparing the same, and more particularly, to an electrophotographic toner including wax and a binder which are appropriately distributed and thus have improved liquidity and durability characteristics and can be preserved for a long period of time without an occurrence of offsets, and a method of preparing the same.

2. Description of the Related Art

Electrophotographic techniques and electrostatic recording techniques use developers that visualize electrostatic images or electrostatic latent images. Developers can be categorized into two-component developers and one-component developers. Two-component developers include toner and carrier particles. One-component developers only include toner. One-component developers can be sub-categorized into magnetic one-component developers that contain a magnetic component and non-magnetic one-component developers that do not contain a magnetic component. Non-magnetic one-component developers generally include a fluidizer to increase a fluidity of the toner. The fluidizer can be colloidal silica. In general, toner refers to color particles that are prepared by dispersing a pigment such as carbon black and additives in latex and forming the dispersion product into particles.

Toner can be prepared by using a grinding method or a polymerizing method. In the grinding method, a synthesized resin, a pigment, and if necessary, additives are dissolved and mixed. The mixture is then ground and the resultant particles are classified in order to obtain particles having a desired diameter. In the polymerizing method of a polymerization toner, a polymerizable monomer, a pigment, a polymerization initiator, and if necessary, additives, such as a crosslinking agent or an antistatic agent, are homogeneously dissolved or dispersed to form a polymerizable monomer composition. The polymerizable monomer composition is then dispersed with an agitator in an aqueous dispersion medium containing a dispersion stabilizer so as to form droplet particles of the polymerizable monomer composition. Then the temperature of the mixture is increased and a suspension-polymerization process is performed thereon in order to obtain color polymerization particles having desired particle diameters.

Meanwhile, image forming apparatuses, such as an electrophotographic apparatus or an electrostatic recording apparatus, form an image by using the following method. First, a homogeneously charged photoreceptor is exposed to light and a latent image is formed. Then, toner is attached to the latent image to form a toner image. The toner image is then transferred to a transfer medium such as a transfer sheet. Then, the un-fixed toner image is fixed onto the transfer medium by, for example, heating, pressing, or solvent evaporating. In the fixing process, in general, the transfer medium onto which the toner image is transferred passes between a fixing roll and a pressing roll and toner of the toner image is heated and pressed, so that the toner image is thereby fused onto the transfer medium.

Some image forming apparatuses, such as electrical photocopiers, require accurate and precise image forming characteristics. Conventionally, toner used in an image forming apparatus is prepared by using a grinding method. However, when the grinding method is used, the obtained toner particles have a wide particle-diameter distribution. Therefore, in order to obtain appropriate development characteristics, the toner particles need to be sorted or classified to reduce the particle-diameter distribution. However, when toner particles for an electrophotographic technique or an electrostatic technique are prepared by using conventional mixing and grinding processes, it is difficult to accurately control particle diameters and the distribution of particle diameters, and thus the yield of small particles is low due to the need for the classification process. In addition, there is a limitation on modification/adjustment of the toner design for improving charging and fixing characteristics. Meanwhile, for polymerization toner, particle diameters can be easily controlled, and complex processes, such as a sorting or a classifying process, are not used. Due to these advantages, polymerization toner is receiving much attention.

As described above, when toner is prepared by using a polymerizing process, polymerization toner having desirable particle diameters and desirable particle-diameter distribution can be obtained without grinding or a classifying process. However, it is still difficult to obtain a uniform particle diameter and a uniform particle shape. That is, toner particles having particle diameters outside a center of a particle size distribution can be easily controlled, but particles having small diameters have a higher level of circularity than a desired circularity level. In addition, for electrophotographic processes, problems may arise when a blade is cleaned.

Furthermore, for toner to have high gloss levels and wide fixing regions, the toner may be prepared in a capsule-like shape by using a coagulation process. Certainly, by controlling a shape of the toner, surface exposure of a pigment and a wax is prevented, and uniform charging, high liquidity, and high thermal preservation can be obtained. An anti-offset characteristic of the toner is considered as an important factor when it comes to a stable fixing region. To obtain the anti-offset characteristic, silicon oil can be coated on a fixing roller. However, when oil is applied, an oil tank and other devices are further needed, a fixing roller may deteriorate, or maintenance may need to be performed frequently. To prevent the fusing phenomenon of the toner, in general, wax can be added to the toner to provide a releasing effect. The releasing effect is significantly dependent on distribution states of a wax and a binder.

Meanwhile, if the distribution of wax on a toner surface is high, liquidity, and charging characteristics are degraded and durability is decreased. On the other hand, if wax is inappropriately distributed in a binder and is located inside a toner, the wax may fail to perform its due function as a releasing agent, high-temperature offsets may occur, and gloss levels may be decreased, and thus, stable image quality cannot be obtained.

SUMMARY OF THE INVENTION

The present general inventive concept provides an electrophotographic toner including wax and a binder which are appropriately distributed and thus have improved liquidity and durability characteristics and which can be preserved for a long period of time without an occurrence of offsets.

Additional aspects and/or utilities of the present general inventive concept will be set forth in part in the description which follows and, in part, will be obvious from the description, or may be learned by practice of the general inventive concept.

The present general inventive concept also provides a method of preparing the electrophotographic toner.

The present general inventive concept also provides a toner supply unit including the electrophotographic toner.

The present general inventive concept also provides an imaging apparatus including the electrophotographic toner.

Exemplary embodiments of the present general inventive concept may be achieved by providing an electrophotographic toner including a latex, a colorant, and a releasing agent, wherein characteristics of the electrophotographic toner measured by using a Fourier transform infrared spectroscopy in an attenuated total reflection mode (FT-IR-ATR), in which an incidence angle is changeable, satisfy inequalities 1 through 3 below:

$$0.6 \leqq P2850/P3027 \leqq 2.2 \quad \text{<Inequality 1>}$$

$$0.95 \leqq (P2850_{50°}/P3027_{50°})/(P2850_{60°}/P3027_{60°}) \leqq 1.5 \quad \text{<Inequality 2>}$$

$$0.95 \leqq (P2850_{60°}/P3027_{60°})/(P2850_{70°}/P3027_{70°}) \leqq 1.5 \quad \text{<Inequality 3>}$$

where

P2850 and P3027 respectively represent peak intensities of a wax and a binder resin and the binder resin alone at 2850 $cm^{-1}$ and 3027 $cm^{-1}$, at a predetermined incidence angle, $P2850_{50°}$ and $P3027_{50°}$ respectively represent peak intensities of the wax and the binder resin at 2850 $cm^{-1}$ and 3027 $cm^{-1}$, at an incidence angle of 50°, $P2850_{60°}$ and $P3027_{60°}$ respectively represent peak intensities of the wax and the binder resin at 2850 $cm^{-1}$ and 3027 $cm^{-1}$, at an incidence angle of 60°, and $P2850_{70°}$ and $P3027_{70°}$ respectively represent peak intensities of the wax and the binder resin at 2850 $cm^{-1}$ and 3027 $cm^{-1}$, at an incidence angle of 70°.

The electrophotographic toner may include about 3 ppm to about 10,000 ppm of Fe.

The releasing agent may include a mixture comprising a paraffin-based wax and an ester-based wax; or an ester group-containing paraffin-based wax.

An amount of the ester-based wax of the releasing agent may be in a range of about 5 to about 39 parts by weight % based on a total weight of the releasing agent.

When measured by using a differential scanning calorimetry (DSC) method, a temperature corresponding to a maximum endothermic peak may be in a range of about 86° C. to about 95° C.

An average particle diameter of the electrophotographic toner may be in a range of about 3 μm to about 9 μm.

An average circularity of the electrophotographic toner may be in a range of about 0.940 to about 0.980.

The electrophotographic toner may have a geometric standard deviation by volume (GSDv) and a geometric standard deviation by number (GSDp), each of which may be about 1.25 or less.

Exemplary embodiments of the present general inventive concept may also be achieved by providing a method of preparing an electrophotographic toner, the method includes preparing a mixed solution by mixing a primary latex particle, a pigment dispersion, and a releasing agent dispersion, preparing a primary coagulated toner by adding a coagulant to the mixed solution, and preparing a secondary coagulated toner by coating the primary coagulated toner with a secondary latex prepared by polymerizing at least one polymerizable monomer, wherein characteristics of the electrophotographic toner measured by using a FT-IR-ATR, in which an incidence angle is changeable, satisfy inequalities 1 through 3 below:

$$0.6 \leqq P2850/P3027 \leqq 2.2 \quad \text{<Inequality 1>}$$

$$0.95 \leqq (P2850_{50°}/P3027_{50°})/(P2850_{60°}/P3027_{60°}) \leqq 1.5 \quad \text{<Inequality 2>}$$

$$0.95 \leqq (P2850_{60°}/P3027_{60°})/(P2850_{70°}/P3027_{70°}) \leqq 1.5 \quad \text{<Inequality 3>}$$

where

P2850 and P3027 respectively represent peak intensities of a wax and a binder resin and the binder resin alone at 2850 $cm^{-1}$ and 3027 $cm^{-1}$, at a predetermined incidence angle, $P2850_{50°}$ and $P3027_{50°}$ respectively represent peak intensities of the wax and the binder resin at 2850 $cm^{-1}$ and 3027 $cm^{-1}$, at an incidence angle of 50°, $P2850_{60°}$ and $P3027_{60°}$ respectively represent peak intensities of the wax and the binder resin at 2850 $cm^{-1}$ and 3027 $cm^{-1}$, at an incidence angle of 60°, and $P2850_{70°}$ and $P3027_{70°}$ respectively represent peak intensities of the wax and the binder resin at 2850 $cm^{-1}$ and 3027 $cm^{-1}$, at an incidence angle of 70°.

The polymerizable monomer may include at least one selected from the group consisting of styrene-based monomers, acrylic acids, methacrylic acid, derivatives of (meth) acrylic acids, ethylenically unsaturated monoolefines, halogenated vinyls, vinyl esters, vinylethers, vinylketones, and nitrogen-containing vinyl compounds.

The releasing agent dispersion may comprise a mixture including a paraffin-based wax and an ester-based wax or an ester group-containing paraffin-based wax.

The coagulant may include a Si and Fe-containing metal salt.

Exemplary embodiments of the present general inventive concept may also be achieved by providing a toner supply unit including a toner tank to store toner, a toner supply unit to supply the stored toner to an outside, and a toner stirrer that is installed to be rotatable inside the toner tank to stir the toner inside the toner tank, wherein the toner comprises an electrophotographic toner which includes a latex, a colorant, and a releasing agent, wherein characteristics of the toner measured by using FT-IR-ATR, in which an incidence angle is changeable, satisfy inequalities 1 to 3:

$$0.6 \leqq P2850/P3027 \leqq 2.2 \quad \text{<Inequality 1>}$$

$$0.95 \leqq (P2850_{50°}/P3027_{50°})/(P2850_{60°}/P3027_{60°}) \leqq 1.5 \quad \text{<Inequality 2>}$$

$$0.95 \leqq (P2850_{60°}/P3027_{60°})/(P2850_{70°}/P3027_{70°}) \leqq 1.5 \quad \text{<Inequality 3>}$$

where

P2850 and P3027 respectively represent peak intensities of a wax and a binder resin and the binder resin alone at 2850 $cm^{-1}$ and 3027 $cm^{-1}$, at a predetermined incidence angle, $P2850_{50°}$ and $P3027_{50°}$ respectively represent peak intensities of the wax and the binder resin at 2850 $cm^{-1}$ and 3027 $cm^{-1}$, at an incidence angle of 50°, $P2850_{60°}$ and $P3027_{60°}$ respectively represent peak intensities of the wax and the binder resin at 2850 $cm^{-1}$ and 3027 $cm^{-1}$, at an incidence angle of 60°, and $P2850_{70°}$ and $P3027_{70°}$ respectively represent peak intensities of the wax and the binder resin at 2850 $cm^{-1}$ and 3027 $cm^{-1}$, at an incidence angle of 70°.

Exemplary embodiments of the present general inventive concept may also be achieved by providing an imaging apparatus including an image bearing member, an imaging unit to form an electrostatic image on the image bearing member, a unit to contain toner, a toner supply unit to supply the toner onto the image bearing member so as to develop the electrostatic image into a toner image on the image bearing member, and a toner transfer unit to transfer the toner image formed on the image bearing member to a transfer medium, wherein the toner comprises an electrophotographic toner including a latex, a colorant, and a releasing agent, wherein characteristics of the toner measured by using FT-IR-ATR, in which an incidence angle is changeable, satisfy inequalities 1 to 3:

where P2850 and P3027 respectively represent peak intensities of a wax and a binder resin and the binder resin alone at 2850 $cm^{-1}$ and 3027 $cm^{-1}$, at a predetermined incidence angle, $P2850_{50°}$ and $P3027_{50°}$ respectively represent peak intensities of the wax and the binder resin at 2850 $cm^{-1}$ and 3027 $cm^{-1}$, at an incidence angle of 50°, $P2850_{60°}$ and $P3027_{60°}$ respectively represent peak intensities of the wax and the binder resin at 2850 $cm^{-1}$ and 3027 $cm^{-1}$, at an incidence angle of 60°, and $P2850_{70°}$ and $P3027_{70°}$ respectively represent peak intensities of the wax and the binder resin at 2850 $cm^{-1}$ and 3027 $cm^{-1}$, at an incidence angle of 70°.

Exemplary embodiments of the present general inventive concept may also be achieved by providing a toner including a latex, a colorant, and a releasing agent, wherein a first ratio of a strength of a peak at 2850 $cm^{-1}$ of the releasing agent and a binding resin to a strength of a peak at 3027 $cm^{-1}$ of the binding resin is greater than or equal to 0.6, and wherein characteristics of the toner is measured by using a Fourier transform infrared spectroscopy in an attenuated total reflection mode (FT-IR-ATR).

The first ratio may be less than or equal to 2.2.

Characteristics of the toner may satisfy inequalities 2 and 3:

$$0.95 \leqq (P2850_{50°}/P3027_{50°})/(P2850_{60°}/P3027_{60°}) \leqq 1.5 \quad \text{<Inequality 2>}$$

$$0.95 \leqq (P2850_{60°}/P3027_{60°})/(P2850_{70°}/P3027_{70°}) \leqq 1.5 \quad \text{<Inequality 3>}$$

where $P2850_{50°}$ and $P3027_{50°}$ respectively represent peak strengths of the releasing agent and the binder resin at 2850 $cm^{-1}$ and 3027 $cm^{-1}$, at an incidence angle of 50°, $P2850_{60°}$ and $P3027_{60°}$ respectively represent peak strengths of the releasing agent and the binder resin at 2850 $cm^{-1}$ and 3027 $cm^{-1}$, at an incidence angle of 60°, and $P2850_{70°}$ and $P3027_{70°}$ respectively represent peak intensities of the releasing agent and the binder resin at 2850 $cm^{-1}$ and 3027 $cm^{-1}$, at an incidence angle of 70°.

Exemplary embodiments of the present general inventive concept may also be achieved by providing a development device of an image forming apparatus, the development device including a toner including a latex, a colorant, and a releasing agent, and a unit to store the toner, wherein a first ratio of a strength of a peak at 2850 $cm^{-1}$ of the releasing agent and a binding resin to a strength of a peak at 3027 $cm^{-1}$ of the binding resin is greater than or equal to 0.6, and wherein characteristics of the toner is measured by using a Fourier transform infrared spectroscopy in an attenuated total reflection mode (FT-IR-ATR).

The first ratio may be less than or equal to 2.2.

Characteristics of the toner may satisfy inequalities 2 and 3:

$$0.95 \leqq (P2850_{50°}/P3027_{50°})/(P2850_{60°}/P3027_{60°}) \leqq 1.5 \quad \text{<Inequality 2>}$$

$$0.95 \leqq (P2850_{60°}/P3027_{60°})/(P2850_{70°}/P3027_{70°}) \leqq 1.5 \quad \text{<Inequality 3>}$$

where $P2850_{50°}$ and $P3027_{50°}$ respectively represent peak strengths of the releasing agent and the binder resin at 2850 $cm^{-1}$ and 3027 $cm^{-1}$, at an incidence angle of 50°, $P2850_{60°}$ and $P3027_{60°}$ respectively represent peak strengths of the releasing agent and the binder resin at 2850 $cm^{-1}$ and 3027 $cm^{-1}$, at an incidence angle of 60°, and $P2850_{70°}$ and $P3027_{70°}$ respectively represent peak intensities of the releasing agent and the binder resin at 2850 $cm^{-1}$ and 3027 $cm^{-1}$, at an incidence angle of 70°.

BRIEF DESCRIPTION OF THE DRAWINGS

The above and/or other features and utilities of the present general inventive concept will become more apparent by describing in detail exemplary embodiments thereof with reference to the attached drawings in which.

DETAILED DESCRIPTION OF THE EMBODIMENTS

Figure 1:
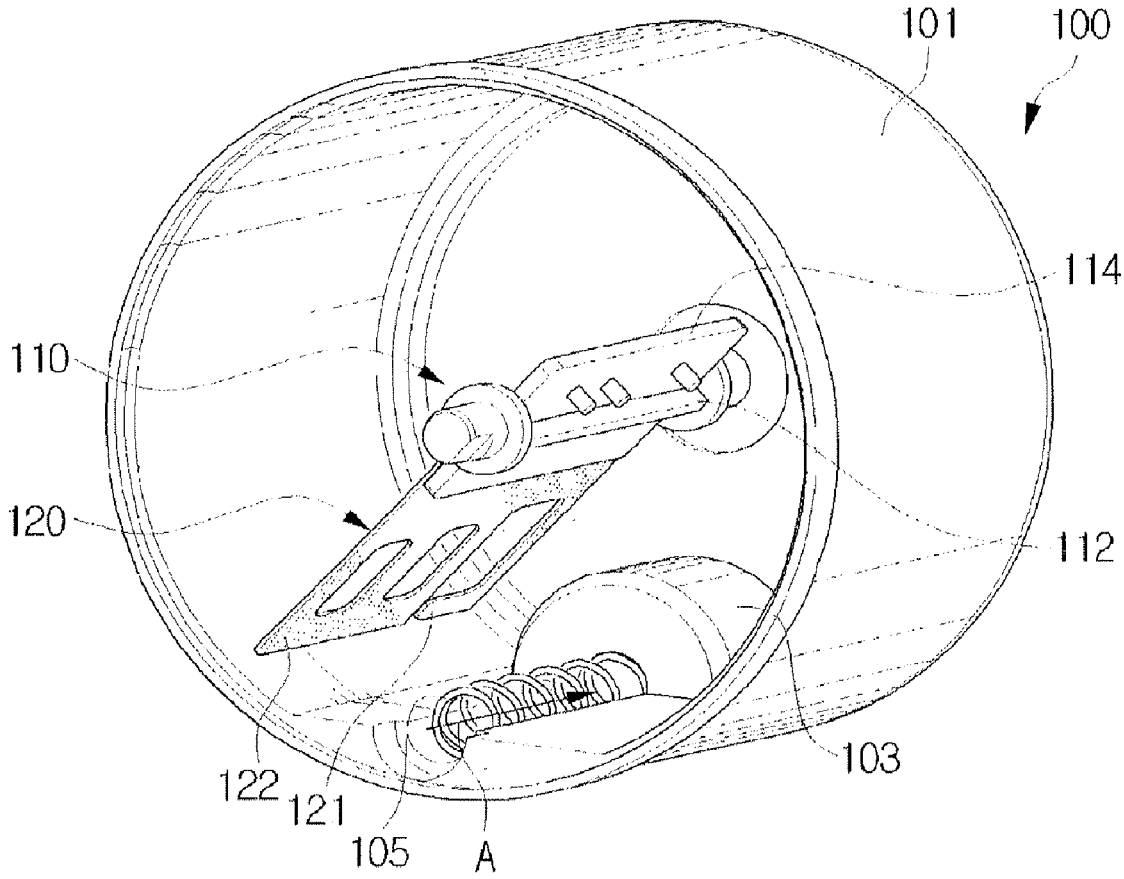
FIG. 1 is a perspective view of a toner supply unit according to an exemplary embodiment of the present general inventive concept.

The present general inventive concept will now be described more fully with reference to the accompanying drawings, in which exemplary embodiments of the present general inventive concept are illustrated. Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

An electrophotographic toner (hereinafter, also referred to as toner) according to an exemplary embodiment of the present general inventive concept includes latex, a colorant, and a releasing agent, and characteristics of the electrophotographic toner measured by using a Fourier transform infrared spectroscopy in the attenuated total reflection mode (FT-IR-ATR), in which an incidence angle is changeable, satisfy Inequalities 1 through 3 below:

$$0.6 \leqq P2850/P3027 \leqq 2.2 \quad \text{<Inequality 1>}$$

$$0.95 \leqq (P2850_{50°}/P3027_{50°})/(P2850_{60°}/P3027_{60°}) \leqq 1.5 \quad \text{<Inequality 2>}$$

$$0.95 \leqq (P2850_{60°}/P3027_{60°})/(P2850_{70°}/P3027_{70°}) \leqq 1.5 \quad \text{<Inequality 3>}$$

where P2850 and P3027 respectively represent peak intensities of a wax and a binder resin and a binder resin alone at 2850 $cm^{-1}$ and 3027 $cm^{-1}$, at a predetermined incidence angle, $P2850_{50°}$ and $P3027_{50°}$ respectively represent peak intensities of the wax and the binder resin at 2850 $cm^{-1}$ and 3027 $cm^{-1}$, at an incidence angle of 50°, $P2850_{60°}$ and $P3027_{60°}$ respectively represent peak intensities of the wax and the binder resin at 2850 $cm^{-1}$ and 3027 $cm^{-1}$, at an incidence angle of 60°, and $P2850_{70°}$ and $P3027_{70°}$ respectively represent peak intensities of the wax and the binder resin at 2850 $cm^{-1}$ and 3027 $cm^{-1}$, at an incidence angle of 70°.

In exemplary embodiments, the FT-IR-ATR is a value which defines an amount of the wax which is present within a portion of a toner particle. The wax may extend from an outermost surface of the toner particle to a depth of about 0.3 μm. However, the present general inventive concept is not limited thereto.

In exemplary embodiments, the P2850/P3027 refers to ratio of a strength of the peak at 2850 $cm^{-1}$ of the wax and the binder to a strength of the peak at 3027 $cm^{-1}$ of the binder alone, wherein the ratio between the two peak strengths is measured according to the FT-IR-ATR.

Inequality 1 relates to an intensity ratio of peaks 2850 $cm^{-1}$ and 3027 $cm^{-1}$ respectively corresponding to a wax and a binder resin, and a binder resin alone, when wax on the toner surface is measured. When Inequality 1 is satisfied, wax is appropriately distributed on a toner surface and thus, a liquidity and a durability of the toner are improved and an offset does not occur while long-term preservation is maintained. If 2.2<P2850/P3027, wax distribution on the toner surface is relatively high and thus, a liquidity and a durability of the toner are decreased and hot offsets may occur. If P2850/P3027<0.6, wax distribution on the toner surface is relatively low and thus, the releasing function of wax may be degraded and thus an offset may occur.

In addition, when a FT-IR is used, a transmission depth may vary according to an incidence angle. Due to such characteristics, information about a distribution of a material according to a depth may be obtained. Accordingly, since the toner is measured at the incidence angles of 50°, 60° or 70° and a transmission depth is relatively decreased, information about a material present near the toner surface can be obtained. That is, as the P2850/P3027 ratio measured as the incidence angle is increased is smaller, wax distribution near the toner surface is relatively low, and when the toner has a core/shell structure, the shell layer appropriately covers the core layer.

When the toner has the core/shell structure in which the shell layer covers the core layer, when P2850/P3027 ratios measured at the incidence angles of 50°, 60° and 70° satisfy Inequalities 2 and 3, an amount of wax present near the toner surface is appropriate and thus the liquidity of the toner is improved and the durability and fixing performance of the toner can be stably maintained.

If peak ratios in Inequality 2 and Inequality 3, that is, $P2850_{50°}/P3027_{50°})/(P2850_{60°}/P3027_{60°})$ or $(P2850_{60°}/P3027_{60°})/(P2850_{70°}/P3027_{70°})$ are less than 0.95, relatively more wax is present near the toner surface than inside the toner and thus the liquidity and the durability of the toner is decreased. However, on the other hand, if $P2850_{50°}/P3027_{50°})/(P2850_{60°}/P3027_{60°})$ or $(P2850_{60°}/P3027_{60°})/(P2850_{70°}/P3027_{70°})$ is larger than 1.5, wax is not distributed well and thus, the wax is not appropriately distributed near the toner surface and is distributed inside the toner. Thus, in a fixing process, the releasing function of wax may be degraded and thus hot-offsets may occur and glossy characteristics may be degraded.

A method of preparing an electrophotographic toner according to an exemplary embodiment of the present general inventive concept includes preparing a mixed solution by mixing a primary latex, a pigment dispersion, and a releasing agent dispersion, preparing a primary coagulated toner by adding a coagulant to the mixed solution, and preparing a secondary coagulated toner by coating the primary coagulated toner with a secondary latex prepared by polymerizing at least one polymerizable monomer, thereby obtaining an electrophotographic toner. The electrophotographic toner satisfies Inequalities 1 through 3 when measured by using FT-IR-ATR in which an incidence angle can be changed:

$$0.6 \leqq P2850/P3027 \leqq 2.2 \quad \text{<Inequality 1>}$$

$$0.95 \leqq (P2850_{50°}/P3027_{50°})/(P2850_{60°}/P3027_{60°}) \leqq 1.5 \quad \text{<Inequality 2>}$$

$$0.95 \leqq (P2850_{60°}/P3027_{60°})/(P2850_{70°}/P3027_{70°}) \leqq 1.5 \quad \text{<Inequality 3>}$$

where P2850, P3027, $P2850_{50°}$, $P3027_{50°}$, $P2850_{60°}$, $P3027_{60°}$, $P2850_{70°}$ and $P3027_{70°}$ are the same as defined above.

With regard to the preparation method, examples of the coagulant may include NaCl, $MgCl_2$, $MgCl_2.8H_20$, $[Al_2(OH)_nCl_{6-n}]_m(Al_2(SO_4)_3.18H_2O$, polyaluminum chloride (PAC), polyaluminum sulfate (PAS), polyaluminum sulfate silicate (PASS), ferrous sulfate, ferric sulfate, ferric chloride, calcium hydroxide, calcium carbonate, and Si and Fe-containing metal salts. However, the coagulant of the present general inventive concept is not limited to these examples.

An amount of the coagulant may be in a range of about 3 to about 16 parts by weight, for example about 5 to about 12 parts by weight, based on 100 parts by weight of the primary latex. If the amount of the coagulant is less than 3 parts by weight based on 100 parts by weight of the primary latex, the coagulation effect may be decreased. On the other hand, if the amount of the coagulant is larger than 16 parts by weight based on 100 parts by weight of the primary latex, the toner may be charged less.

According to an exemplary embodiment of the present general inventive concept, the coagulant used to prepare the electrophotographic toner may be a Si and Fe-containing metal salt and the amount of Fe contained in the resultant toner is in a range of about 3 ppm to about 10,000 ppm. If the amount of Fe is less than 3 ppm, a sufficient coagulation effect may not be obtained. On the other hand, if the amount of Fe is larger than 10,000 ppm, the toner may be charged less.

In exemplary embodiments, the Si and Fe-containing metal salt may include poly silica iron. With regard to the method of preparing an electrophotographic toner according to the present general inventive concept, ionic strength increased by adding the Si and Fe-containing metal salt and collisions between particles may contribute to an increase in a size of the primary coagulated toner. The Si and Fe-containing metal salt may be poly silica iron. Exemplary embodiments of the poly silica iron include model names PSI-025, PSI-050, PSI-075, PSI-100, PSI-200, and PSI-300 (manufactured by Suido Kiko Co.). Table 1 illustrates physical properties and compositions of PSI-025, PSI-050, PSI-075, PSI-100, PSI-200, and PSI-300.

TABLE 1

| Type | | PSI-025 | PSI-050 | PSI-075 | PSI-100 | PSI-200 | PSI-300 |
|---|---|---|---|---|---|---|---|
| Silica/Fe mole ratio (Si/Fe) | | 0.25 | 0.5 | 0.75 | 1 | 2 | 3 |
| Main component concentration | Fe (wt %) | 5.0 | 3.5 | 5.0 | 2.0 | 1.0 | 0.7 |
| | SiO2 (wt %) | 1.4 | 1.9 | 1.4 | | 2.2 | |
| pH (1 w/v %) | | | | 2-3 | | | |
| Specific gravity (20° C.) | | 1.14 | 1.13 | 1.09 | 1.08 | 1.06 | 1.04 |

TABLE 1-continued

| Type | PSI-025 | PSI-050 | PSI-075 | PSI-100 | PSI-200 | PSI-300 |
|---|---|---|---|---|---|---|
| Viscosity (mPa · S) | | | 2.0 or more | | | |
| Average molecular weight (Dalton) | | | 500,000 | | | |
| External appearance | | | Yellowish brown transparent liquid | | | |

Since a Si and Fe-containing metal salt is used as a coagulant in the method of preparing an electrophotographic toner according to the present general inventive concept, particles can be formed in small sizes and the shape of particles can also be controlled. A volume average particle diameter of an electrophotographic toner according to an exemplary embodiment of the present general inventive concept may be in a range of about 3 μm to about 9 μm. In general, smaller toner particles are useful to obtain high-resolution and high image quality, but are disadvantageous in terms of transfer speeds and washing abilities. Thus, it is important that toner particles have appropriate particle diameters. The volume average particle diameter of the electrophotographic toner may be measured by using a light scattering method. If the volume average particle diameter of the electrophotographic toner is less than 3 μm, an image bearing member may not be cleaned well and a production yield may be decreased when mass-produced. In addition, the toner may be harmful to humans due to asbestos. On the other hand, if the volume average particle diameter of the electrophotographic toner is larger than 9 μm, high resolution and high image quality cannot be obtained, the toner may be non-uniformly charged, fixing characteristics of the toner may be degraded, and it is difficult for a doctor blade to control a toner layer.

According to an exemplary embodiment of the present general inventive concept, an average circularity of the toner may be in a range of about 0.940 to about 0.980. If the average circularity of the toner is less than 0.940, an image developed on a transfer medium has a large thickness and thus toner consumption may be increased and voids between toner particles are too large. As a result, the image developed on the transfer medium may have an insufficient coverage ratio. Thus, in order to obtain a desired image concentration, more toner is required and the toner consumption is increased. On the other hand, if the average circularity of the toner is larger than 0.980, an excessive amount of toner may be supplied onto a development sleeve and thus the sleeve may be non-uniformly coated with the toner.

The circularity of the toner can be measured by using the following method. First, 50 toner particles illustrated in a scanning electron microscopic (SEM) image of the toner are selected. Then, the circularity of the toner is measured by using software for image material quantification analysis, such as software Image J software 1.33u (National Institutes of Health, USA) based on Equation 4.

$$\text{Circularity}=4\pi\times(\text{area}/\text{circumference}^2) \quad \text{<Equation 4>}$$

The circularity may be in a range of about 0 to about 1, and as the circularity approaches 1, the toner particle shape becomes more circular.

According to an exemplary embodiment of the present general inventive concept, when measured by using a differential scanning calorimetry (DSC) method, a temperature corresponding to a maximum endothermic peak is in a range of about 86° C. to about 95° C.

Meanwhile, a toner particle distribution coefficient may be geometric standard deviation by volume GSDv or a geometric standard deviation by number GSDp. Each of the GSDv and GSDp of the electrophotographic toner according to the present general inventive concept may be about 1.25 or less, for example, in a range of about 1.20 to about 1.25. If each of GSDv and GSDp is larger than 1.25, particle diameters may have a non-uniform distribution.

The GSDv and the GSDp may be measured in the following manner.

First, a toner particle diameter distribution is obtained by using toner particle diameters measured using a Coulter counter (Multisizer 3, Beckman Coulter, Inc., USA). The toner particle diameter distribution is divided at predetermined particle diameter ranges (channel). With respect to the respective divided particle diameter ranges (channels), a cumulative volume distribution of toner particles and a cumulative number distribution of toner particles are measured, wherein, in each of the cumulative volume and number distributions, the particle size in each distribution is increased in a direction from left to right. A particle diameter at 16% of the respective cumulative distributions is defined as a volume average particle diameter D16v and a number average particle diameter D16p, respectively. Likewise, a particle diameter at 50% of the respective cumulative distributions is defined as a volume average particle diameter D50v and a number average particle diameter D50p, respectively. Likewise, a particle diameter at 84% of the respective cumulative distributions is defined as a volume average particle diameter D84v and a number average particle diameter D84p. In this case, GSDv is defined as a ratio of D84v/D16v, and GSDp is defined as a ratio of D84p/D16p.

In the method of preparing an electrophotographic toner, the primary latex may be polyester, a polymer prepared by polymerizing at least one polymerizable monomer, or a mixture thereof (hybrid). When a polymer is used, at least one polymerizable monomer may be polymerized together with a releasing agent, such as wax, in the polymerizing process, or the polymer may be mixed with the releasing agent.

The polymerizing process may be an emulsion polymerization distribution process. As a result of the emulsion polymerization distribution process, the primary latex particles may have a particle size of about 1 μm or less, for example, in a range of about 100 nm to about 300 nm.

Exemplary embodiments of the polymerizable monomer used herein may include styrene-based monomers such as styrene, vinyltoluene, or α-methylstyrene; acrylic acids, methacrylic acids; derivatives of (meth)acrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonirile, methacrylonirile, acrylamide, or methacrylamide; ethylenically unsaturated monoolefines such as ethylene, propylene, or butylene; halogenated vinyls such as vinyl chloride, vinylidene chloride, or vinyl fluoride; vinyl esters such as vinyl acetate or vinyl propionate; vinylethers such as vinylmethylether or vinylethylether; vinylketones such as vinylmethylketone or methylisoprophenylketone; and a nitrogen-containing vinyl compound such as 2-vinylpyridine, 4-vinylpyridine, or N-vinylpyrrolidone. However, the present general inventive concept is not limited thereto.

When the primary latex is manufactured, a polymerization initiator and a chain transfer agent may be further used to efficiently perform the polymerization process.

Exemplary embodiments of the polymerization initiator may include persulfates such as potassium persulfate or ammonium persulfate, azo compounds such as 4,4-azobis(4-cyano valeric acid), dimethyl-2,2'-azobis(2-methylpropionate), 2,2-azobis(2-amidinopropane)dihydrochloride, 2,2-azobis-2-methyl-N-1,1-bis(hydroxymethyl)-2-hydroxyethylpropioamide, 2,2'-azobis(2,4-dimethylvaleronirile), 2,2'-azobisisobutyronirile, or 1,1'-azobis(1-cyclohexancarbonirile), and peroxides such as methylethylperoxide, di-t-butylperoxide, acetylperoxide, dikumylperoxide, lauroylperoxide, benzoylperoxide, t-butylperoxy-2-ethylhexanoate, di-isopropylperoxydicarbonate, or di-t-butylperoxyisophthalate. In addition, oxidation-reduction initiators prepared by combining these polymerization initiators and reductants may also be used as the polymerization initiator.

The chain transfer agent refers to a material that changes a type of a chain carrier when a chain reaction occurs. Due to the chain transfer agent, a polymerization degree of polymerizable monomers can be reduced and a novel chain can be initiated. Due to the chain transfer agent, molecular weight distributions can be controlled.

An amount of the chain transfer agent may be in a range of about 0.5 to about 5.0 parts by weight, for example, about 1.0 to about 4.0 parts by weight, based on 100 parts by weight of one polymerizable monomer. If the amount of the chain transfer agent is less than 0.5 parts by weight based on 100 parts by weight of one polymerizable monomer, a molecular weight of the polymer is too high. On the other hand, if the amount of the chain transfer agent is larger than 5.0 parts by weight based on 100 parts by weight of one polymerizable monomer, a molecular weight of the polymer is too low.

Exemplary embodiments of the chain transfer agent include sulfur-containing compounds such as dodecanethiol, thioglycolic acid, thioacetic acid, or mercaptoethanol; phosphorous acid compounds such as a phosphorous acid or sodium phosphorous acid; hypophosphorous acid compounds such as a hypophosphorous acid or a sodium hypophosphorous acid; and alcohols such as methylalcohols, ethylalcohols, isopropylalcohols, or n-butylalcohols. However, the present general inventive concept is not limited thereto.

The primary latex may further include a charge controller. The charge controller used in exemplary embodiments of the present general inventive concept may be a negatively charged charge controller or a positively charged charge controller. Exemplary embodiments of the negatively charged charge controller include chelate compounds organic metal complex such as a chrominum-containing azo complex or a monoazo metal complex; metal-containing salicylic acid compounds wherein the metal may be chrominum, iron, or zinc; and organic metal complexes such as aromatic hydroxycarboxylic acids or aromatic dicarboxylic acid. However, the negatively charged charge controller may not be particularly limited as long as it is known in the art. Exemplary embodiments of the positively charged charge controller include products that are reformed with nigrosine or fatty acid metal salt thereof, and onium salts containing tributylbenzylammonium 1-hydroxy-4-naphthosulfonate or a tertiary ammonium salt such as tetrabutylammonium tetrafluoroborate. These positively charged charge controllers may be used alone or in combination. The charge controller stably supports toner on a development roller with an electrostatic force. Thus, by using the charge controller, stable and high charging speeds can be obtained.

The primary latex obtained as described above may be mixed with the pigment dispersion and the releasing agent dispersion to prepare the mixed solution. The pigment dispersion may be obtained by uniformly dispersing a composition including a pigment, such as a black pigment, a cyan pigment, a magenta pigment, or a yellow pigment, and an emulsifier by using an ultrasonic homogenizer or a micro fluidizer.

Among pigments used to prepare the pigment dispersion, the black pigment may be a carbon black or aniline black. For color toner, at least one pigment selected from the group consisting of the cyan pigment, the magenta pigment, and the yellow pigment may be further used in addition to the black pigment.

The yellow pigment may be a condensation nitrogen compound, an isoindolinone compound, an anthraquine compound, an azo metal complex, or an alyl imide compound. Exemplary embodiments of the yellow pigment include C.I. pigment yellows 12, 13, 14, 17, 62, 74, 83, 93, 94, 95, 109, 110, 111, 128, 129, 147, 168, and 180.

Exemplary embodiments of the magenta pigment include condensation nitrogen compounds, anthraquine compounds, quinacridone compounds, base dye rate compounds, naphthol compounds, benzo imidazole compounds, thioindigo compounds, and perylene compounds. Specifically, examples of the magenta pigment include C.I. pigment reds 2, 3, 5, 6, 7, 23, 48:2, 48:3, 48:4, 57:1, 81:1, 122, 144, 146, 166, 169, 177, 184, 185, 202, 206, 220, 221, and 254.

Exemplary embodiments of the cyan pigment include copper phthalocyanie compounds and derivatives thereof, anthraquine compounds, and base dye rate compounds. Examples of the cyan pigment include C.I. pigment blues 1, 7, 15, 15:1, 15:2, 15:3, 15:4, 60, 62, and 66.

These pigments may be used alone or in combination, and may be selected in consideration of color, chroma, brightness, weather resistance, or dispersibility in toner.

An amount of the pigment used to prepare the pigment dispersion may be in a range of about 0.1 to about 20 parts by weight based on 100 parts by weight of the polymerizable monomer. The pigment may be used in any amount that is sufficient to colorize the toner. If the amount of the pigment is less than 0.1 parts by weight based on 100 parts by weight of the polymerizable monomer, a sufficient coloring effect may not be obtained. On the other hand, if the amount of the pigment is larger than 20 parts by weight, the manufacturing costs of the toner may increase and thus a sufficient electrification quantity may not be obtained.

The emulsifier used to prepare the pigment dispersion may be any emulsifier that is known in the art. For example, the emulsifier may be an anionic reactive emulsifier, a non-ionic reactive emulsifier, or a mixture thereof. The anionic reactive emulsifier may be HS-10 (manufactured by Dai-ich kogyo Inc.) or Dawfax 2-A1 (manufactured by Rhodia Inc.). The non-ionic reactive emulsifier may be RN-10 (manufactured by Dai-ichi kogyo).

In exemplary embodiments, the releasing agent dispersion used to prepare the electrophotographic toner as described above may include a releasing agent, water, or an emulsifier.

The releasing agent enables the toner to be fixed to a final image receptor at a low fixing temperature and to have excellent final image durability and abrasion-resistance characteristics. Thus, characteristics of the toner are dependent upon the type and the amount of the releasing agent contained therein.

An available releasing agent may be, but is not limited to, polyethylene-based wax, polypropylene-based wax, silicon wax, paraffin-based wax, ester-based wax, carnauba wax, or metallocene wax. The melting point of the releasing agent may be, for example, in a range of about 50° C. to about 150° C. In exemplary embodiments, the releasing agent may be physically attached to the toner particles, but does not covalently bind to the toner particles. Such a releasing agent enables the toner to be fixed to a final image receptor at a low fixing temperature and to have excellent final image durability and abrasion-resistance characteristics.

The amount of the releasing agent may be in a range of about 1 to about 20 parts by weight, for example, about 5 to about 10 parts by weight, based on 100 parts by weight of at least one polymerizable monomer. If the amount of the releasing agent is less than 5 parts by weight based on 100 parts by weight of at least one polymerizable monomer, low-temperature characteristics of the toner may be degraded and a fixing temperature range may be narrowed. On the other hand, if the amount of the releasing agent is larger than 10 parts by weight based on 100 parts by weight of at least one polymerizable monomer, preservation characteristics may be degraded and the manufacturing costs of the toner may increase.

The releasing agent may be ester group-containing wax. Exemplary embodiments of the ester group-containing wax include (1) mixtures including ester-based wax and non-ester based wax; and (2) non-ester based wax containing an ester group.

Since an ester group has a high affinity with respect to the latex component of toner, wax can be uniformly present among toner particles and the function of the wax is effectively exerted. Meanwhile, if only ester-based wax is used, excessive plasticizing reactions may occur. Thus, the inclusion of the non-ester based wax may result in prevention of such excessive plasticizing reactions due to a releasing reaction with respect to the latex. Therefore, development characteristics of the toner can be maintained at appropriate levels for a long period of time.

Exemplary embodiments of the ester-based wax include C15-C30 fatty acids and esters of 1 to 5 valent alcohols, such as behenic acid behenyl, staric acid stearyl, stearic acid ester of pentaeritritol, or montanic acid glyceride. Also, if an alcohol component that forms ester is a monovalent alcohol, a number of carbons may be in a range of 10 to 30, and if the alcohol component that forms ester is a polymeric alcohol, the number of carbons may be in the range of 3 to 10.

The non-ester based wax may be polymethylene-based wax or paraffin-based wax.

Exemplary embodiments of the ester group-containing wax include mixtures including paraffin-based wax and ester based wax and ester group-containing paraffin-based wax. Exemplary embodiments of the ester group-containing wax include P-212, P-280, P-318, P-319, P-419, P-420, and P-421 (Chukyo yushi Co., Ltd)

An amount of the ester-based wax of the releasing agent may be in a range of about 5 to about 39 parts by weight % based on the total weight of the releasing agent. If the amount of the ester-based wax is less than 5 parts by weight % based on the total weight of the releasing agent, compatibility of the ester-based wax with respect to the primary latex is reduced. On the other hand, if the amount of the ester based wax is larger than 39 weight %, plasticizing characteristics of the toner are too strong and thus, development characteristics of the toner cannot be maintained for a long period of time.

Like the emulsifier used in the pigment dispersion, the emulsifier used in the releasing agent dispersion may be any emulsifier that is known in the art. Exemplary embodiments of the emulsifier used in the releasing agent dispersion may include an anionic reactive emulsifier, a non-ionic reactive emulsifier, and mixtures thereof. The anionic reactive emulsifier may be HS-10 (manufactured by Dai-ich kogyo Inc.), or Dawfax 2-A1 (Rhodia Inc.). The non-ionic reactive emulsifier may be RN-10 (manufactured by Dai-ichi kogyo Inc).

Due to the method described above, the primary latex particles may have a molecular weight, $T_g$, and rheological characteristics which are appropriately controlled to be fixed at a low temperature.

The primary latex particles, the pigment dispersion and the releasing agent dispersion as described above are mixed to obtain a mixed solution, and then a coagulant is added to the mixed solution to thereby prepare a coagulated toner. In exemplary embodiments, the primary latex particles, the pigment dispersion, and the releasing agent dispersion are mixed and then the coagulant is added thereto at a pH in a range of about 1 to about 4, thereby preparing a primary coagulated toner with particles having a size of 2.5 μm or less. The primary coagulated toner may act as a core. Then, a secondary latex is added thereto and then a pH of the system used is controlled to be in a range of about 6 to about 8. Then, when a particle size is maintained constant for a predetermined time period, a temperature of the mixture is increased to about 90° C. to about 96° C. and the pH is decreased to about 6 to about 5.8, thereby preparing a secondary coagulated toner.

The coagulant may include at least one salt selected from the group consisting of Si and Fe-containing metal salts. In exemplary embodiments, the Si and Fe-containing metal salts may include poly silica iron.

The secondary latex may be obtained by polymerizing the at least one polymerizable monomer as described above. The polymerization process may be an emulsion polymerization distribution process. As a result of the emulsion polymerization distribution process, the secondary latex particles may have a particle size of about 1 μm or less, for example, in a range of about 100 nm to about 300 nm.

Meanwhile, the at least one polymerizable monomer as described above may be further coated on the secondary coagulated toner, to thereby obtain a tertiary latex.

By forming the shell layer by using the secondary latex or the tertiary latex, the toner obtains high durability and excellent preservation characteristics during shipping and handling. In this case, a polymerization inhibitor may be further added to prevent the formation of new latex particles, and starved-feeding conditions may be used to appropriately coat a monomer mixed solution on the toner.

The obtained secondary coagulated toner or tertiary coagulated toner is filtered to isolate toner particles and the isolated toner particles are dried. Then, an external additive is added to the dried toner and an amount of charge applied is controlled, thereby obtaining a final dry toner.

The external additive may be silica or $TiO_2$. An amount of the external additive may be in a range of about 1.5 to about 4 parts by weight, for example, about 2 to about 3 parts by weight, based on 100 parts by weight of toner to which the external additive is not added. If the amount of the external additive is less than 1.5 parts by weight based on 100 parts by weight of toner to which the external additive is not added, toner particles may be attached to each other due to a coagulation force and a caking phenomenon which occurs and the amount of charge applied is unstable. On the other hand, if the amount of the external additive is larger than 4 parts by weight based on 100 parts by weight of toner to which the external additive is not added, the external additive may contaminate a roller.

An imaging method according to an exemplary embodiment of the present general inventive concept includes attaching toner to a surface of an image bearing member on which an electrostatic latent image is formed so as to form a visible image and transferring the visible image onto a transfer medium, wherein the toner is an electrophotographic toner including latex, a colorant, and a releasing agent, and characteristics of the toner measured by using FT-IR-ATR, in which an incidence angle is changeable, satisfy Inequalities 1 to 3 as follows:

$$0.6 \leqq P2850/P3027 \leqq 2.2 \quad \text{<Inequality 1>}$$

$$0.95 \leqq (P2850_{50°}/P3027_{50°})/(P2850_{60°}/P3027_{60°}) \leqq 1.5 \quad \text{<Inequality 2>}$$

$$0.95 \leqq (P2850_{60°}/P3027_{60°})/(P2850_{70°}/P3027_{70°}) \leqq 1.5 \quad \text{<Inequality 3>}$$

where P2850, P3027, $P2850_{50°}$, $P3027_{50°}$, $P2850_{60°}$, $P3027_{60°}$, $P2850_{70°}$ and $P3027_{70°}$ are the same as defined as described above.

In general, an electrophotographic imaging method includes a charging process, an exposing process, a developing process, a transferring process, a fixing process, a cleaning process, and a charge-removing process, in order to form an image on a receptor.

In the charging process, a negative charge or a positive charge is applied to a photoreceptor by corona or a charging roller. In the exposing process, the charged surface of the photoreceptor is selectively discharged to form a latent image by using an optical system such as a laser scanner or a diode arrangement. The latent image is formed in an imagewise manner such that the latent image corresponds to a desired image to be formed on a final image receptor. The optical system uses electromagnetic radiation, also referred to as "light," which may be infrared light radiation, visible light radiation, or ultra-violet light radiation. However, the present general inventive concept is not limited thereto.

In the developing process, particles of the toner having a sufficient polarity contact the latent image formed on the photoreceptor, and a developer having the same potential polarity as that of the toner, conventionally an electrically-biased developer, is further used. The toner particles move toward the photoreceptor and are selectively attached to the latent image of the photoreceptor by an electrostatic force, to thereby form a toner image on the photoreceptor.

In the transferring process, the toner image is transferred from the photoreceptor to a final image receptor. In some cases, an intermediate transferring element may be used to transfer the toner image from the photoreceptor to the final image receptor.

In the fixing process, the toner image on the final image receptor is heated so that particles of the toner are softened or dissolved and are fixed to the final image receptor. Alternatively, the toner image may be fixed to the final image receptor by heating or by compression at high pressure without heating.

In the cleaning process, residual toner remaining on the photoreceptor is removed.

Finally, in the charge-removing process, the charge of the photoreceptor is exposed to light having a specific wavelength band and is thereby uniformly reduced to a low value. Therefore, the residue of the latent image may be removed and the photoreceptor is made available for a subsequent imaging cycle.

A toner supply unit according to an exemplary embodiment of the present general inventive concept includes a toner tank to store toner, a toner supply unit that protrudes inside the toner tank and supplies the stored toner to an outside, and a toner stirrer that is installed to be rotatable inside the toner tank, and stirs toner inside the toner tank including toner located in an upper portion of the toner supply unit, wherein the toner is an electrophotographic toner including latex, a colorant, and a releasing agent, and characteristics of the toner measured by using FT-IR-ATR, in which an incidence angle is changeable, satisfy Inequalities 1 to 3 as follows:

$$0.6 \leqq P2850/P3027 \leqq 2.2 \quad \text{<Inequality 1>}$$

$$0.95 \leqq (P2850_{50°}/P3027_{50°})/(P2850_{60°}/P3027_{60°}) \leqq 1.5 \quad \text{<Inequality 2>}$$

$$0.95 \leqq (P2850_{60°}/P3027_{60°})/(P2850_{70°}/P3027_{70°}) \leqq 1.5 \quad \text{<Inequality 3>}$$

where P2850, P3027, $P2850_{50°}$, $P3027_{50°}$, $P2850_{60°}$, $P3027_{60°}$, $P2850_{70°}$ and $P3027_{70°}$ are the same as defined as described above.

FIG. 1 is a perspective view of a toner supply unit 100 according to an exemplary embodiment of the present general inventive concept.

Referring to FIG. 1, the toner supply unit 100 according to the present exemplary embodiment includes a toner tank 101, a supplier 103, a toner transferring member 105, and a toner stirring member 110.

The toner tank 101 contains a predetermined amount of toner, and may be formed as hollow-cylindrical tube.

The supplier 103 is installed in an inner lower part of the toner tank 101, and may supply toner contained in the toner tank 101 to an outside. For example, the supplier 103 protrudes from a bottom of the toner tank 101 to an inside of the toner tank 101 in a pillar shape with a semi-circular section. A toner-discharge pore (not illustrated) through which the toner is discharged, is formed in one end of the supplier 103.

The toner transferring member 105 is formed in the inner lower part of the toner tank 101 and on a side of the supplier 103. The toner transferring member 105 may be coil-spring shaped and one end of the toner transferring member 105 extends toward an inside of the supplier 103. Due to the structure of the toner transferring member 105, when the toner transferring member 105 rotates, the toner contained in the toner tank 101 is transferred to the inside of the supplier 103 in a toner-supply direction denoted by an arrow A. The toner transferred by the toner transferring member 105 to the supplier 103 is discharged to the outside through the toner-discharge pore.

The toner stirring member 110 is rotatably installed inside the toner tank 101 and forces the toner contained in the toner tank 101 to move downward. That is, when the toner stirring member 110 rotates at a center of the toner tank 101, the toner contained in the toner tank 101 is stirred and is not solidified and is thus moved downward due to a force, such as gravity. The toner stirring member 110 includes a rotary shaft 112 and a toner stirring film 120. The rotary shaft 112 rotates at the center of the toner tank 101, and a driving gear (not illustrated) is installed on one end of the rotary shaft 112 to protrude toward one side of the toner tank 101. Accordingly, when the driving gear rotates, the rotary shaft 112 rotates. That is, the driving gear and the rotary shaft 112 are integrally formed as one body and rotate together. In addition, the rotary shaft 112 may include an alar plate 114 to easily install the toner stirring film 120. In this regard, the alar plate 114 may be symmetrical with respect to the rotary shaft 112. The toner stirring film 120 has a width which corresponds to an inner length of the toner tank 101 and is elastic so that the toner stirring film 120 can be deformed corresponding to a protrusion inside the toner tank 101, that is, the supplier 103. That is, a portion of the toner stirring film 120 which corresponds to the supplier 103 may be deformed. However, the present general inventive concept is not limited thereto. In exemplary embodiments, the toner stirring film 120 may include deformable portions which correspond to various other components within the toner tank 101.

The toner stirring film 120 may be cut to a predetermined length in a direction which extends from an end of the toner stirring film 120 to the rotary shaft 112, to thereby form a first stirring portion 121 and a second stirring portion 122.

An imaging apparatus according to an exemplary embodiment of the present general inventive concept includes an image bearing member, an imaging unit to form an electrostatic image on the image bearing member, a unit to contain toner, a toner supply unit to supply toner to the image bearing member so as to develop the electrostatic image into a toner image on the image bearing member, and a toner transfer unit to transfer the toner image formed on the image bearing member to a transfer medium, wherein the toner is an electrophotographic toner including latex, a colorant, and a releasing agent, and characteristics of the toner measured by using FT-IR-ATR, in which an incidence angle is changeable, satisfy Inequalities 1 to 3 as follows:

$$0.6 \leqq P2850/P3027 \leqq 2.2 \quad \text{<Inequality 1>}$$

$$0.95 \leqq (P2850_{50°}/P3027_{50°})/(P2850_{60°}/P3027_{60°}) \leqq 1.5 \quad \text{<Inequality 2>}$$

$$0.95 \leqq (P2850_{60°}/P3027_{60°})/(P2850_{70°}/P3027_{70°}) \leqq 1.5 \quad \text{<Inequality 3>}$$

where P2850, P3027, $P2850_{50°}$, $P3027_{50°}$, $P2850_{60°}$, $P3027_{60°}$, $P2850_{70°}$ and $P3027_{70°}$ are the same as defined as described above.

Figure 2:
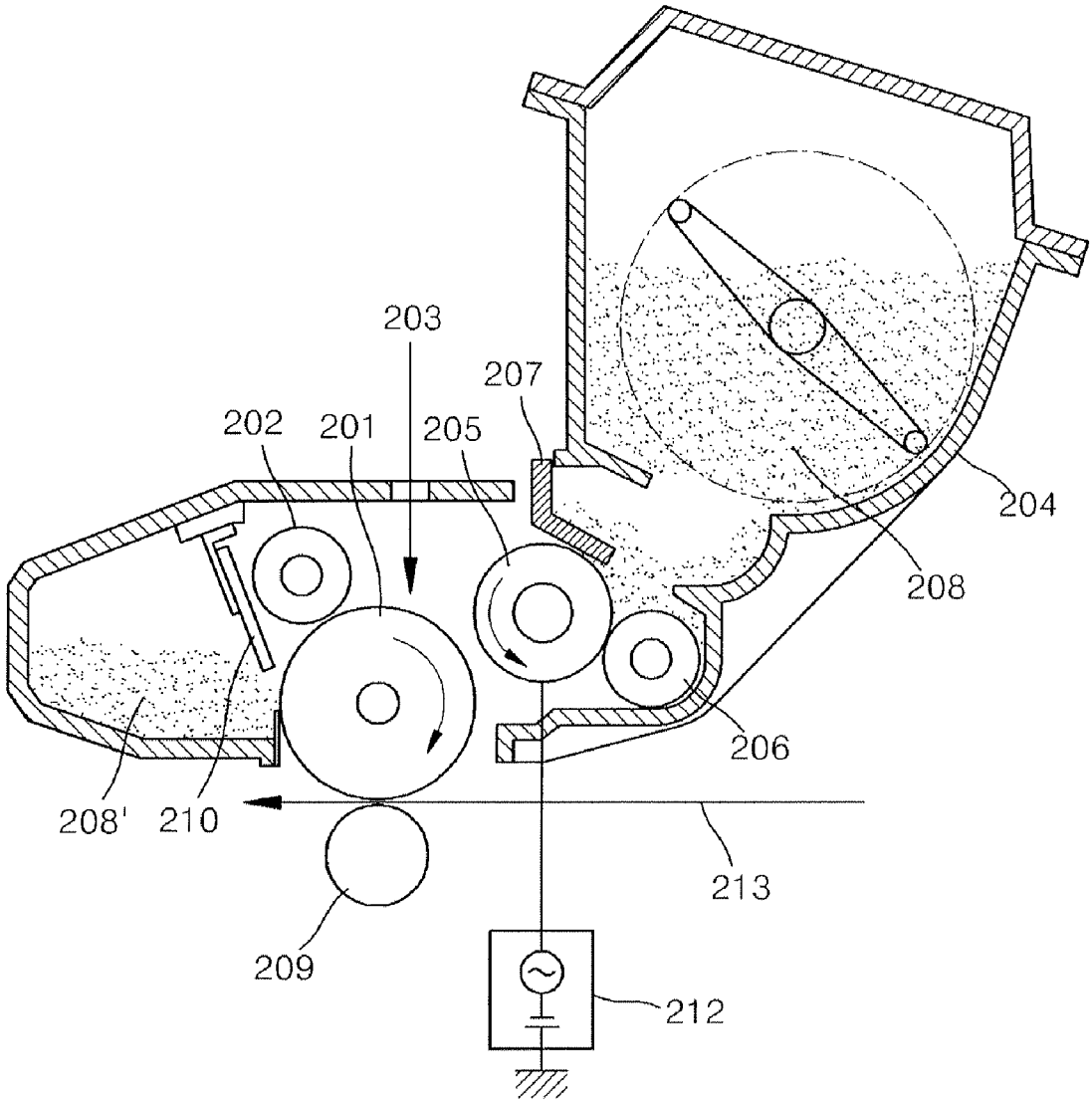
FIG. 2 is a schematic cross-sectional view of an imaging apparatus including a toner prepared according to an exemplary embodiment of the present general inventive concept.

FIG. 2 is a schematic cross-sectional view of a non-contact development type imaging apparatus according to an exemplary embodiment of the present general inventive concept. The non-contact development type imaging apparatus according to the present exemplary embodiment includes toner prepared according to the present general inventive concept. Hereinafter, the operational principal of the non-contact development type imaging apparatus illustrated in FIG. 2 will be described in detail.

Referring to FIG. 2, a non-magnetic one-component developer 208 of a development device 204 is supplied to a development roller 205 by a supply roller 206. The supply roller 206 may be formed of an elastic material, such as polyurethane foam or sponge. Then, the non-magnetic one-component developer 208 reaches a contact portion between a developer controlling blade 207 and the development roller 205 when the development roller 205 rotates. The developer controlling blade 207 may be formed of an elastic material, such as metal or rubber. When the non-magnetic one-component developer 208 passes through the contact portion between the developer controlling blade 207 and the development roller 205, the non-magnetic one-component developer 208 is formed into a uniform film and is sufficiently charged. The film is transferred to a development area of a photoreceptor 201, constituting a latent image carrier, by the development roller 205, so that a latent image in the development area is developed. In this regard, the latent image is formed by irradiating light 203 to the photoreceptor 201.

The development roller 205 faces the photoreceptor 201 and is spaced apart from the photoreceptor 201 by a predetermined distance. The development roller 205 rotates in a counter-clockwise direction and the photoreceptor 201 rotates in a clockwise direction.

By applying an electrical force, the non-magnetic one-component developer 208 transferred to the development area of the photoreceptor 201 develops the latent image formed on the photoreceptor 201, and thus a toner image is formed. Herein, the electrical force is generated due to a potential difference between a direct current (DC)-accompanied alternative current (AC) voltage applied to the development roller 205 and a potential of the latent image on the photoreceptor 201 charged by a charging member 202.

The non-magnetic one-component developer 208 on the photoreceptor 201 reaches a transfer member 209 according to a rotation direction of the photoreceptor 201. The non-magnetic one-component developer 208 on the photoreceptor 201 is transferred to a print medium 213 by the transfer member 209 due to a corona discharge, or a high voltage of opposite polarity to that of the non-magnetic one-component developer 208 which is applied to the transfer member 209 when the print medium 213 passes by the transfer member 209. In exemplary embodiments, a voltage source 212 may be connected to the development roller 205 to provide a voltage thereto.

The image transferred to the print medium 213 is fused onto the print medium 213 when the non-magnetic one-component developer 208 passes through a high-temperature and high-pressure fusing device (not illustrated). Meanwhile, residue developer 208' disposed on the development roller 205 is collected by the supply roller 206 contacting the development roller 205, and the residue developer 208' disposed on the photoreceptor 201 is collected by a cleaning blade 210. These image-forming operations described above may be repeated.

The present general inventive concept will now be described in further detail with reference to the following examples. These examples are for illustrative purposes only and are not intended to limit the scope of the present inventive concept.

Preparation Example 1

Synthesis of Primary Latex

A dispersion of wax and monomer was prepared as follows.

A monomer mixed solution (234 g of styrene, 96 g of n-butyl acrylate, 14 g of methacrylic acid, and 6.5 g of poly (ethylene glycol)-ethyl ether methacrylate) and 5 g of 1-dodecanethiol acting as a chain transfer agent (CTA) were added to 500 g of sodium dodecyl sulfate (Aldrich) aqueous solution (2% compared to water) acting as an emulsifier, and the mixture was emulsified by using an ultrasonic homogenizer at a temperature in a range of 60° C. to 80° C., thereby preparing a monomer-emulsified solution. The monomer-emulsified solution was added to a 3 L double-jacketed reactor heated to a reaction temperature of 80° C., and then 860 g of an initiator (KPS) aqueous solution in which 3.2 weight % of the initiator is contained was added thereto. Then, the reactants were reacted for 2 hours under a nitrogen atmosphere. When the reaction was completed, a monomer mixed solution (145 g of styrene, 66 g of n-butyl acrylate, and 9 g of methacrylic acid) and 3.3 g of 1-dodecanethiol were added to a reactor in a starved feeding fashion for 60 minutes and then the resultant mixture was reacted for 6 hours and then naturally cooled to obtain a primary latex. After the cooling, the particle size of the primary latex was measured by using a light scattering-type Horiba 910. The average particle size measured was 140 nm.

Preparation of Pigment Dispersion 10 g of a mixture including an anionic reactive emulsifier (HS-10; DAI-ICH KOGYO) and a non-ionic reactive emulsifier (RN-10; DAI-ICH KOGYO) in a ratio illustrated in Table 2 below was milled together with 60 g of a pigment (black, cyan, magenta, yellow) in a milling bath containing 400 g of glass beads having a diameter in a range of 0.8 to 1 mm at room temperature, thereby obtaining a dispersion. A homogenizer used in this experiment was an ultrasonic homogenizer (sonic and materials, VCX750).

TABLE 2

| Color | Type of Pigment | HS-10:RN-10 (ratio) | Size |
|---|---|---|---|
| Black | Mogul-L | 100:0 | 130 nm |
| | | 80:20 | 120 nm |
| | | 0:100 | 100 nm |
| Yellow | PY-84 | 100:0 | 350 nm |
| | | 50:50 | 290 nm |
| | | 0:100 | 280 nm |
| magenta | PR-122 | 100:0 | 320 nm |
| | | 50:50 | 300 nm |
| | | 0:100 | 290 nm |
| cyan | PB 15:4 | 100:0 | 130 nm |
| | | 80:20 | 120 nm |
| | | 80:30 | 120 nm |

Coagulation and Preparation of Toner

Example 1

A mixed solution including 15 g (0.3 mol) of a nitric acid and 15 g of PSI-025 (Suido Kiko Co.) was added to a mixed solution including 500 g of deionized water, 136 g of the primary latex as a core, 35 g of the cyan pigment dispersion (HS-10 100%), and 28 g of wax dispersion P-419 (manufactured by Chukyo yushi Co., Ltd) in a 1 L reactor, and then stirred by using a homogenizer at a rate of 11,000 rpm for 6 minutes, thereby obtaining a coagulate having a particle size of 1.5 to 2.5 μm. The resultant mixed solution was added to a 1 L double-jacketed reactor and then the temperature was increased by 0.5° C. per minute from room temperature to 51.5° C. (Tg-5° of latex). When the particle size reached about 5.8 μm, 64 g of a secondary latex obtained by polymerizing (polystyrene-based) polymerizable monomers was added thereto. When the volume average particle diameter D50 (Volume) was 6.0 μm, NaOH (1 mol) was added to the reaction solution to control a pH to be 6.8. When the volume average particle diameter D50 (Volume) was maintained constant for 10 minutes, the temperature was increased to 96° C. at a rate of 0.5° C./min. When the temperature was 96° C., a nitric acid (0.3 mol) was added to the reaction solution to control the pH to be 5.9. Then, the reaction was performed for 3 to 5 hours to obtain a secondary coagulated toner having an elliptical shape and a particle size of 5-6 μm. Then, the coagulated reaction solution was cooled to a temperature lower than Tg and then, a filtering operation was performed to isolate toner particles. The toner particles were then dried.

External additives were added to the toner by adding 0.5 parts by weight of NX-90 (Nippon Aerosil), 1.0 parts by weight of RX-200 (Nippon Aerosil), and 0.5 parts by weight of SW-100 (Titan Kogyo) to 100 parts by weight of the dried toner particles and then, the mixture was stirred using a mixer (KM-LS2K, Daehwa Tech.) at a rate of 8,000 rpm for 4 minutes. The resultant toner had the volume average particle diameter D50 (Volume) of 5.9 μm. GSDp and GSDv of the final toner were 1.24 and 1.23, respectively. The circularity of the final toner was 0.95.

Example 2

A mixed solution including 15 g (0.3 mol) of a nitric acid and 15 g of PSI-025 (Suido Kiko Co.) was added to a mixed solution including 500 g of deionized water, 136 g of the primary latex as a core, 35 g of the cyan pigment dispersion (HS-10 100%), and 28 g of wax dispersion P-419 (manufactured by Chukyo yushi Co., Ltd) in a 1 L reactor, and then stirred using a homogenizer at a rate of 11,000 rpm for 6 minutes, thereby obtaining a coagulate having a particle size of 1.5 to 2.5 μm. The resultant mixed solution was added to a 1 L double-jacketed reactor and then the temperature was increased by 0.5° C. per minute from room temperature to 51.5° C. (Tg-5° of latex). When the particle size reached about 5.8 μm, 64 g of a secondary latex obtained by polymerizing (polystyrene-based) polymerizable monomers was added thereto. When the volume average particle diameter D50 (Volume) was 6.0 μm, NaOH (1 mol) was added to the reaction solution to control a pH to be 7.0. When the volume average particle diameter D50 (Volume) was maintained constant for 10 minutes, the temperature was increased to 96° C. at a rate of 0.5° C./min. When the temperature was 96° C., a nitric acid (0.3 mol) was added to the reaction solution to control the pH to be 5.5. Then, the reaction was performed for 3 to 5 hours to obtain a secondary coagulated toner having an elliptical shape and a particle size of 5-6 μm. Then, the coagulated reaction solution was cooled to a temperature lower than Tg and then, a filtering operation was performed to isolate toner particles and the toner particles were dried.

External additives were added to the toner by adding 0.5 parts by weight of NX-90 (Nippon Aerosil), 1.0 parts by weight of RX-200 (Nippon Aerosil), and 0.5 parts by weight of SW-100 (Titan Kogyo) to 100 parts by weight of the dried toner particles and then, the mixture was stirred using a mixer (KM-LS2K, Daehwa Tech.) at a rate of 8,000 rpm for 4 minutes. The resultant toner had the volume average particle diameter D50 (Volume) of 5.9 μm. GSDp and GSDv of the final toner were 1.23 and 1.22, respectively. The circularity of the final toner was 0.97.

Comparative Example 1

Toner was prepared in the same manner as in Example 1, except that the coagulation temperature was increased to 51° C. The volume average particle diameter D50 (Volume) of the final toner was 5.9 μm. The GSDp and GSDv of the final toner were 1.22 and 1.23, respectively. The circularity of the final toner was 0.97.

Comparative Example 2

Toner was prepared in the same manner as in Example 1, except that an amount of the primary latex used was 150 g and an amount of the secondary latex was 50 g. The volume average particle diameter D50 (Volume) of the final toner was 5.9 μm. The GSDp and GSDv of the final toner were 1.24 and 1.26, respectively. The circularity of the final toner was 0.98.

Comparative Example 3

Toner was prepared in the same manner as in Example 1, except that only 200 g of the primary latex was used without using of the secondary latex. The volume average particle diameter D50 (Volume) of the final toner was 5.9 μm. The GSDp and GSDv of the final toner were 1.24 and 1.25, respectively. The circularity of the final toner was 0.98.

Comparative Example 4

Toner was prepared in the same manner as in Example 1, except that a wax dispersion was not used.

The volume average particle diameter D50 (Volume) of the final toner was 5.9 μm. The GSDp and GSDv of the final toner were 1.24 and 1.25, respectively. The circularity of the final toner was 0.98.

Experimental Example

With respect to the toners prepared according to Examples 1 and 2 and Comparative Examples 1 to 4, P1=P2850/P3027, P2=$(P2850_{50°}/P3027_{50°})/(P2850_{60°}/P3027_{60°}$, P3=$(P2850_{60°}/P3027_{60°})/(P2850_{70°}/P3027_{70°})$, liquidity, charging characteristics, durability, and fixing characteristics were measured. The results are illustrated in Table 3.

For the toners prepared according to Comparative Examples 1 and 2 having values of Inequalities 2 and 3 of less than 0.95, more wax is present near the toner surface than inside the toner and thus, the liquidity and durability of the toner are decreased. On the other hand, for the toner prepared according to Comparative Example 1 having values of Inequalities 2 and 3 of greater than 1.5, wax is inappropriately distributed. That is, toner is not appropriately distributed near the toner surface and is distributed inside the toner. Thus, the wax may not exert its function as a releasing agent and a hot offset may occur and gloss of toner may be decreased and fixing characteristics may be degraded.

The surface wax, liquidity, charging characteristics, durability, and fixing characteristics of the toners were measured using by the following methods.

TABLE 3

| | Surface wax | | | | | Durability | | Fixing Characteristics | |
|---|---|---|---|---|---|---|---|---|---|
| | Incidence angle [°] | P1 | P2 P3 | Liquidity % | Charging Characteristics HH/LL | Streak | High-temperature packaging characteristics | Hot-offset [° C.] | Gloss |
| Example1 | 50 | 1.383 | 1.03 | 57.1 | 0.86 | ○ | ○ | 240 | 4.6 |
| | 60 | 1.340 | 1.08 | | | | | | |
| | 70 | 1.246 | | | | | | | |
| Example2 | 50 | 1.404 | 1.01 | 56.8 | 0.88 | ○ | ○ | 240 | 5.2 |
| | 60 | 1.391 | 1.04 | | | | | | |
| | 70 | 1.336 | | | | | | | |
| Comparative Example1 | 50 | 2.400 | 1.58 | 69.9 | 0.60 | X | X | 200 | 3.9 |
| | 60 | 1.514 | 0.85 | | | | | | |
| | 70 | 1.778 | | | | | | | |
| Comparative Example2 | 50 | 1.612 | 0.99 | 72 | 0.57 | X | X | 230 | 4.2 |
| | 60 | 1.619 | 0.73 | | | | | | |
| | 70 | 2.207 | | | | | | | |
| Comparative Example3 | 50 | 2.320 | 0.97 | 80 | 0.64 | X | X | 180 | 4.5 |
| | 60 | 2.394 | 0.95 | | | | | | |
| | 70 | 2.521 | | | | | | | |
| Comparative Example4 | 50 | 0.598 | 1.03 | 53 | 0.58 | ○ | ○ | 180 | 2.0 |
| | 60 | 0.578 | 0.97 | | | | | | |
| | 70 | 0.596 | | | | | | | |

As illustrated in Table 3, for the toners prepared according to Comparative Examples 1 to 3 having 2.2 or higher of a peak intensity ratio of 2850 $cm^{-1}$ and 3027 $cm^{-1}$ peaks (P2850 and P3027) respectively corresponding to a wax and a binder resin, and the binder resin alone, the wax distribution on the surface of the toner is relatively high and thus, a liquidity of the toner is decreased, durability is degraded and a hot offset occurred. For the toner prepared according to Comparative Example 4 having less than 0.6 of a peak intensity ratio of 2850 $cm^{-1}$ and 3027 $cm^{-1}$ peaks (P2850 and P3027) respectively corresponding to the wax and the binder resin, and the binder resin alone, liquidity, durability, and fixing characteristics were degraded.

Also, as illustrated in Table 3, when P2850/P3027 values of toner in which a core layer is covered by a shell layer, are measured at an incidence angle of 50°, 60°, and 70° satisfy Inequalities 2 and 3, the amount of wax present near the toner surface is appropriate and thus, the liquidity of toner is improved, and the obtained toner has stable durability and fixing characteristics.

$$0.95 \leqq (P2850_{50°}/P3027_{50°})/(P2850_{60°}/P3027_{60°}) \leqq 1.5 \quad \text{<Inequality 2>}$$

$$0.95 \leqq (P2850_{60°}/P3027_{60°})/(P2850_{70°}/P3027_{70°}) \leqq 1.5 \quad \text{<Inequality 3>}$$

Toner Surface Wax Evaluation

Equipment: FT-IR with ATR

FT-IR: Excalibur series manufactured by BIO-RAD Inc.

ATR: HARRICK Seagull (variable incident angle accessory)

Amount of sample used: 1 to 1.5 g

Pre-treatment: pellets (25 mm) were manufactured using a press mold

Evaluation method: Toner pellets were loaded into the ATR and evaluated at incidence angles of 50, 60, and 70 degrees Data Process: An intensity ratio (P2850/P3027) of peaks 2850 $cm^{-1}$ and 3027 $cm^{-1}$ respectively corresponding to a wax and a binder, and binder alone was evaluated Toner Coagulation (Liquidity) Evaluation (Carr's Cohesion)

Equipment: Hosokawa micron powder tester PT-S

Amount of sample used: 2 g (toner to which external additives are added or not added)

Amplitude: 1 mm_dial 3~3.5

Sieve: 53, 45, 38 um

Vibration time: 120 sec

Toner was preserved at 23° C. at RH 55% for 2 hours, and then the amount of toner in the respective sieves under the conditions described above was measured.

[(the amount (parts by weight) of powder remaining in the largest sieve)/2 g]×100 (1)

[(the amount (parts by weight) of powder remaining in the medium-sized sieve)/2 g]×100×(3/5) (2)

[(the amount (parts by weight) of powder remaining in the smallest sieve)/2 g]×100×(1/5) (3)

Carr's Cohesion=(1)+(2)+(3)

Toner Charging Characteristics Evaluation 28.5 g of a carrier and 1.5 g of toner were added to 60 ml of glass container and then stirred using a turbula mixer, and then, an electric field separation method was used to measure the amount of toner charged.

In general, evaluation is made based on charge stability of toner according to a mixing time period at room temperature and room humidity and high temperature and high humidity/low temperature and low humidity charge amount ratios. The present general inventive concept evaluated toners based on high humidity/low temperature and low humidity charge amount ratios.

Room temperature and room humidity: 23° C., RH 55%
High temperature and high humidity: 32° C., RH 80%
Low temperature and low humidity: 10° C., RH 10%

Toner Durability Evaluation

<Streak Evaluation>

Equipment: color laser printer (manufacturer: Samsung Electronics, Model name: a fixing unit of color laser 660 mode) was used under 20 PPM operating conditions of 20 PPM to print 500 pieces of paper with 0% of image. Then, whether contamination occurred or not was identified based on formation of streaks. The results are denoted by ○, Δ, and x. "○" refers to when contamination occurred, "Δ" refers to when contamination occurred but did not affect an image, and "x" refers to when contamination occurred and affected an image.

<High-Temperature Preservation Evaluation>

External additives were added to 100 g of toner, and then the resultant toner was loaded onto a developing unit. The developer was preserved in a constant temperature and constant humidity oven while being packaged.

23° C., 55% RH (Relative Humidity) 2 hr
=>40° C., 90% RH 48 hr
=>50° C., 80% RH 48 hr
=>40° C., 90% RH 48 hr
=>23° C., 55% RH 6 hr After preserved under the conditions described above, it was identified with the naked eye whether caking occurred in toner in the developer, and then 100% images were printed and image defects were evaluated.

Evaluation Standard
○: good image quality, no caking
Δ: poor image quality, no caking
X: poor image quality, caking <Toner Fixing Characteristics Evaluation>

Hot Offset
Equipment: Belt-type fixing device
Unfixed image for test: 100% pattern
Test temperature: 100~200° C. (interval of 10° C.)
Speed: 160 mm/sec
Stay time: 0.08 sec After this experiment was performed under the conditions described above, a hot offset was evaluated as follows.

HOT: HOT offset temperature (the lowest temperature at which hot-offsets occur)

<Toner's Gloss Evaluation>

This evaluation was measured using a glossmeter [at 160° C. while using the fixing device]

Evaluation angle: 60°
Evaluation pattern: 100% pattern

An electrophotographic toner according to the present general inventive concept includes wax and a binder which are appropriately distributed. Thus, the electrophotographic toner has excellent liquidity and durability and can be preserved for a long period of time without an occurrence of offsets. Therefore, the electrophotographic toner can be usefully applied in various toner supply members and imaging apparatuses, and can be applied to various imaging methods.

While the present general inventive concept has been particularly illustrated and described with reference to exemplary embodiments thereof, it will be understood by those of ordinary skill in the art that various changes in form and details may be made therein without departing from the spirit and scope of the present general inventive concept as defined by the following claims and their equivalents.

What is claimed is:

1. An electrophotographic toner comprising:
a latex;
a colorant; and
a releasing agent including a wax,
wherein characteristics of the electrophotographic toner measured by using a Fourier transform infrared spectroscopy in an attenuated total reflection mode (FT-IR-ATR), in which an incidence angle is changeable, satisfy Inequalities 1 through 3 below:

$$0.6 \leqq P2850/P3027 \leqq 2.2 \quad \text{<Inequality 1>}$$

$$0.95 \leqq (P2850_{50°}/P3027_{50°})/(P2850_{60°}/P3027_{60°}) \leqq 1.5 \quad \text{<Inequality 2>}$$

$$0.95 \leqq (P2850_{60°}/P3027_{60°})/(P2850_{70°}/P3027_{70°}) \leqq 1.5 \quad \text{<Inequality 3>}$$

where
P2850 and P3027 respectively represent peak intensities of the wax and a binder resin and the binder resin alone at 2850 $cm^{-1}$ and 3027 $cm^{-1}$, at a predetermined incidence angle,
$P2850_{50°}$ and $P3027_{50°}$ respectively represent peak intensities of the wax and the binder resin at 2850 $cm^{-1}$ and 3027 $cm^{-1}$, at an incidence angle of 50°,
$P2850_{60°}$ and $P3027_{60°}$ respectively represent peak intensities of the wax and the binder resin at 2850 $cm^{-1}$ and 3027 $cm^{-1}$, at an incidence angle of 60°, and
$P2850_{70°}$ and $P3027_{70°}$ respectively represent peak intensities of the wax and the binder resin at 2850 $cm^{-1}$ and 3027 $cm^{-1}$, at an incidence angle of 70°.

2. The electrophotographic toner of claim 1, wherein the electrophotographic toner comprises about 3 ppm to about 10,000 ppm of Fe.

3. The electrophotographic toner of claim 1, wherein the releasing agent comprises a mixture comprising a paraffin-based wax and an ester-based wax; or an ester group-containing paraffin-based wax.

4. The electrophotographic toner of claim 3, wherein an amount of the ester-based wax of the releasing agent is in a range of about 5 to about 39 parts by weight % based on a total weight of the releasing agent.

5. The electrophotographic toner of claim 1, wherein, when measured by using a differential scanning calorimetry (DSC) method, a temperature corresponding to a maximum endothermic peak is in a range of about 86° C. to about 95° C.

6. The electrophotographic toner of claim 1, wherein an average particle diameter of the electrophotographic toner is in a range of about 3 μm to about 9 μm.

7. The electrophotographic toner of claim 1, wherein an average circularity of the electrophotographic toner is in a range of about 0.940 to about 0.980.

8. The electrophotographic toner of claim 1, wherein the electrophotographic toner has a geometric standard deviation by volume (GSDv) and a geometric standard deviation by number (GSDp), each of which is about 1.25 or less.

9. The electrophotographic toner of claim 1, wherein the latex includes a primary latex and a secondary latex.

10. The electrophotographic toner of claim 9, wherein the toner includes a coagulated toner that includes the primary latex and is coated with the secondary latex prepared by polymerizing at least one polymerizable monomer.

11. The electrophotographic toner of claim 10, wherein an amount of the releasing agent is in a range of about 1 to about 20 parts by weight based on 100 parts by weight of the at least one polymerizable monomer.

* * * * *